United States Patent [19]

Villanyi

[11] Patent Number: 4,631,443

[45] Date of Patent: Dec. 23, 1986

[54] MULTIBEAM ELECTRON GUN HAVING A FORMED TRANSITION MEMBER

[75] Inventor: Sigmund T. Villanyi, Lancaster Township, Lancaster County, Pa.

[73] Assignee: RCA Corporation, Princeton, N.J.

[21] Appl. No.: 769,734

[22] Filed: Aug. 27, 1985

[51] Int. Cl.[4] ..... H01J 29/82; H01J 29/50

[52] U.S. Cl. ..... 313/417; 313/447; 313/451; 313/456

[58] Field of Search ..... 313/417, 448, 456, 457, 313/451, 447, 414, 446

[56] References Cited

U.S. PATENT DOCUMENTS

| | | | |
|---|---|---|---|
| 4,298,818 | 11/1981 | McCandless | 313/417 |
| 4,500,808 | 2/1985 | McCandless | 313/409 |
| 4,520,292 | 5/1985 | van Hekken et al. | 313/412 |
| 4,558,254 | 12/1985 | Opresko | 313/446 |

OTHER PUBLICATIONS

U.S. patent application Ser. No. 643,175, entitled, "Multibeam Electron Gun Having a Cathode-Grid Subassembly and Method of Assembling Same", filed on Aug. 22, 1984, by McCandless et al.

U.S. patent application Ser. No. 643,314, entitled, "Structure for and Method of Aligning Beam-Defining Apertures by Means of Alignment Apertures", filed on Aug. 22, 1984, by S. T. Villanyi.

U.S. patent application Ser. No. 735,261, entitled, "Multibeam Electron Gun Having a Transition Member and Method for Assembling the Electron Gun", filed on May 17, 1985, by H. E. McCandless.

"Multibeam Electron Gun Having Means for Positioning a Screen Grid Electrode", filed concurrently herewith by A. K. Wright; U.S. patent application Ser. No. 769,978.

"Multibeam Electron Gun Having Means for Positioning a Screen Grid Electrode Relative to a Main Focusing Lens", filed concurrently herewith by S. T. Opresko; U.S. patent application Ser. No. 769,970.

*Primary Examiner*—Palmer C. DeMeo

*Attorney, Agent, or Firm*—Eugene M. Whitacre; Dennis H. Irlbeck; Vincent J. Coughlin, Jr.

[57] ABSTRACT

The novel electron gun comprises, as in prior guns, a plurality of cathode assemblies and at least two spaced successive electrodes having aligned apertures therethrough for passage of a plurality of electron beams. The cathode assemblies and the electrodes are individually held in position from a common ceramic member. The ceramic member has a first major surface and an oppositely disposed second major surface with a metallized pattern formed on at least a portion of each major surface. The electrodes are attached to the first major surface, and the cathode assemblies are attached to the second major surface. A transition member is attached to the metallized pattern on the first major surface. The transition member includes a substantially flat portion attached to the metallized pattern on the first surface and two upright portions substantially perpendicular to the flat portion and substantially parallel to each other. One of the electrodes is disposed between the upright portions and attached thereto so that the electrode is longitudinally spaced from the other electrode.

5 Claims, 4 Drawing Figures

MULTIBEAM ELECTRON GUN HAVING A FORMED TRANSITION MEMBER

BACKGROUND OF THE INVENTION

The present invention relates to an improved multibeam electron gun and particularly to an electron gun in which a control grid (G1) electrode and a screen grid (G2) electrode are individually attached to a common ceramic member.

U.S. Pat. No. 4,298,818 issued to McCandless on Nov. 3, 1981 discloses an electron gun having a plurality of cathode assemblies and at least two spaced, successive electrodes having aligned apertures which are individually attached directly to a metallized pattern on a common ceramic member. Longitudinal spacing between the successive electrodes is provided by the accurately dimensioned parallel flanges on each of the electrodes and by the flatness of the surface of the ceramic member to which the electrodes are attached. Variations in surface flatness of the ceramic member or in the flange heights of the electrodes will cause corresponding variations in spacing between the successive electrodes. Proper operation of a multibeam cathode-ray tube utilizing such an electron gun requires that the spacing and alignment between successive electrodes in the electron gun be accurately maintained. Apertures that are misaligned by as little as 0.127 mm (0.5 mils) can cause distorted beam shapes and degrade the performance of the tube.

U.S. Pat. No. 4,500,808, issued to McCandless on Feb. 19, 1985, describes an improved electron gun similar to that of U.S. Pat. No. 4,298,818 except that the second electrode comprises a composite structure having a metal support plate brazed directly to a metallized pattern on one surface of a ceramic support. The metal support plate has a window therein opposite each of the apertures in a first electrode which is also brazed directly to a separate metallized pattern on the same surface of the ceramic support. Separate metal plates are brazed to the metal support plate and close the windows therein. Each of the metal plates has a single electron beam-defining aperture therein which is separately aligned with one of the apertures in the first electrode. This structure provides more accurate alignment of successive grid apertures than previous structures, however the longitudinal spacing between the successive electrode also depends upon the flatness of the surface of the ceramic member and the flange heights of the first electrode and of the metal support plate of the second electrode.

SUMMARY OF THE INVENTION

The novel electron gun comprises, as in prior guns, a plurality of cathode assemblies and at least two spaced, successive electrodes having aligned apertures therethrough for passage of a plurality of electron beams. The cathode assemblies and the electrodes are individually held in position from a common ceramic member. The ceramic member has a first major surface and an oppositely disposed second major surface with a metallized pattern formed on at least a portion of each major surface. The electrodes are attached to the first major surface, and the cathode assemblies are attached to the second major surface. A transition member is disposed on the first major surface of the ceramic member. Unlike prior guns, the transition member includes a substantially flat portion attached to the metallized pattern and two upright portions substantially perpendicular to the flat portion and substantially parallel to each other. One of the electrodes is disposed between the upright portions and attached thereto so that the electrode is longitudinally spaced from the other electrode.

DETAILED DESCRIPTION OF THE PREFERRED EMBODIMENT

Figure 1:
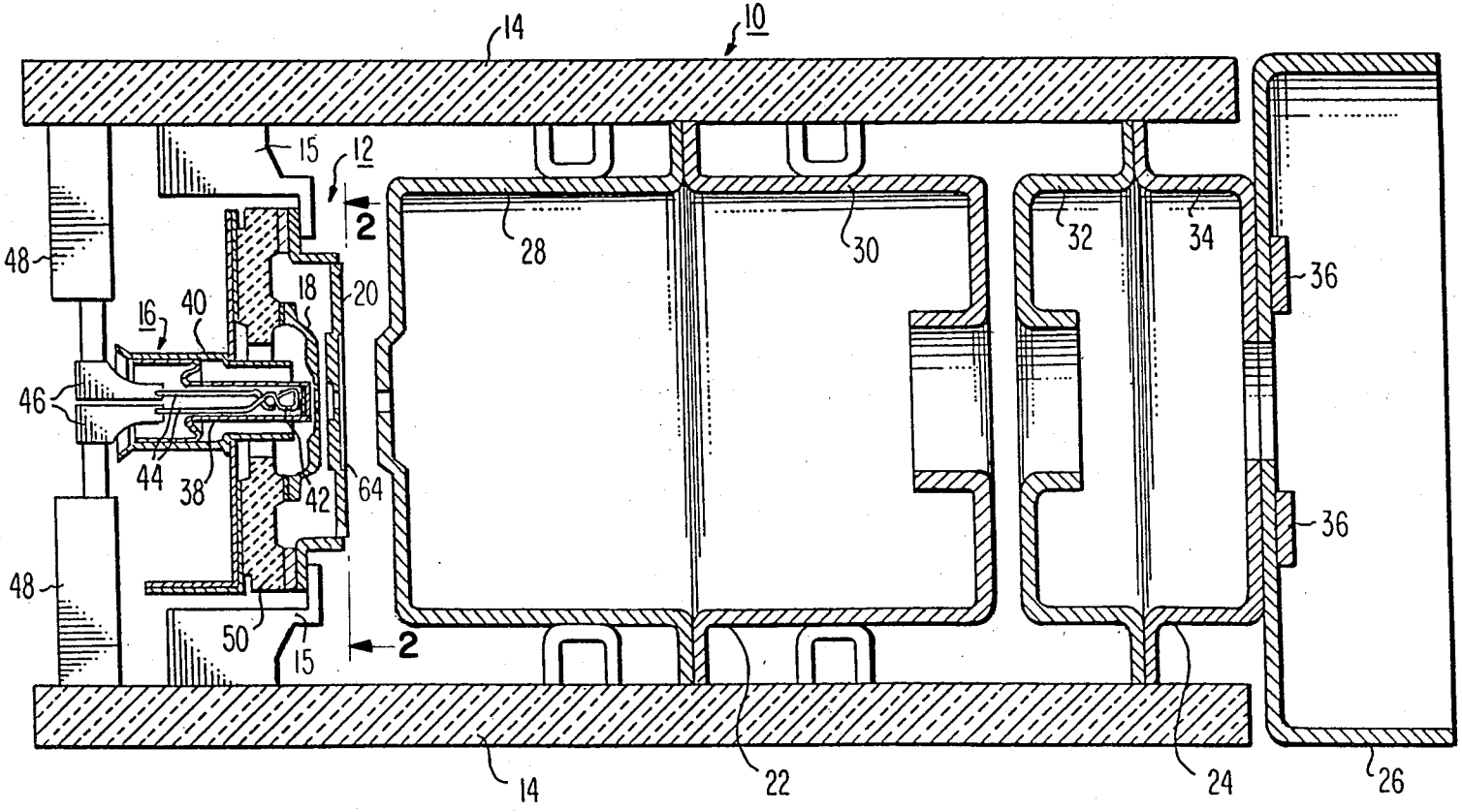
FIG. 1 is a partially cut-away, side elevational view of a preferred embodiment of the novel electron gun.

As shown in FIG. 1, an improved electron gun 10 includes a modular beam-forming region (BFR) assembly 12 secured to a pair of glass support rods 14, also called beads, by a plurality of metal bead support members 15. The modular BFR assembly 12 includes three equally spaced inline cathode assemblies 16, one for each electron beam (only one of which is shown in the view of FIG. 1), a control grid (G1) electrode 18 and a screen grid (G2) electrode 20. Longitudinally spaced from the BFR assembly 12 is a main focusing lens comprising a first focusing (G3) electrode 22 and a second focusing (G4) electrode 24. A shield cup 26 is affixed to the second focusing electrode 24.

The first focusing electrode 22 comprises a substantially rectangularly cup-shaped lower first member 28 and a similarly shaped upper first member 30 joined together at their open ends. The closed ends of the members 28 and 30 have three apertures therethrough, although only the center apertures are shown in FIG. 1. The apertures in the first focusing electrode 22 are aligned with the apertures in the control and screen grid electrodes 18 and 20. The second focusing electrode 24 also comprises two rectangularly cup-shaped members, including a lower second member 32 and an upper second member 34 joined together at their open ends. Three inline apertures also are formed in the closed ends of the upper and lower second members 32 and 34, respectively. The center apertures in the upper and lower second members 32 and 34 are aligned with the center apertures in the other electrodes; however, the two outer apertures (not shown) in the second focusing electrode 24 are slightly offset outwardly with respect to the two outer apertures in the first focusing electrode 22 to aid in convergence of the outer beams with the center beam. The shield cup 26, located at the output end of the gun 10, has appropriate coma correction members 36 located on its base around or near the electron beam paths, as is known in the art. The first and second focusing electrodes 22 and 24, respectively, are affixed to the support rods 14.

Each of the cathode assemblies 16 comprises a substantially cylindrical cathode sleeve 38 closed at the forward end and having an electron emissive coating (not shown) thereon. The cathode sleeve 38 is supported at its open end within a cathode eyelet 40. A heater coil 42 is positioned within the sleeve 38 in order to indirectly heat the electron emissive coating. The heater coil 42 has a pair of legs 44 which are welded to heater straps 46 which, in turn, are welded to support studs 48 that are embedded in the glass support rods 14.

Figure 2:
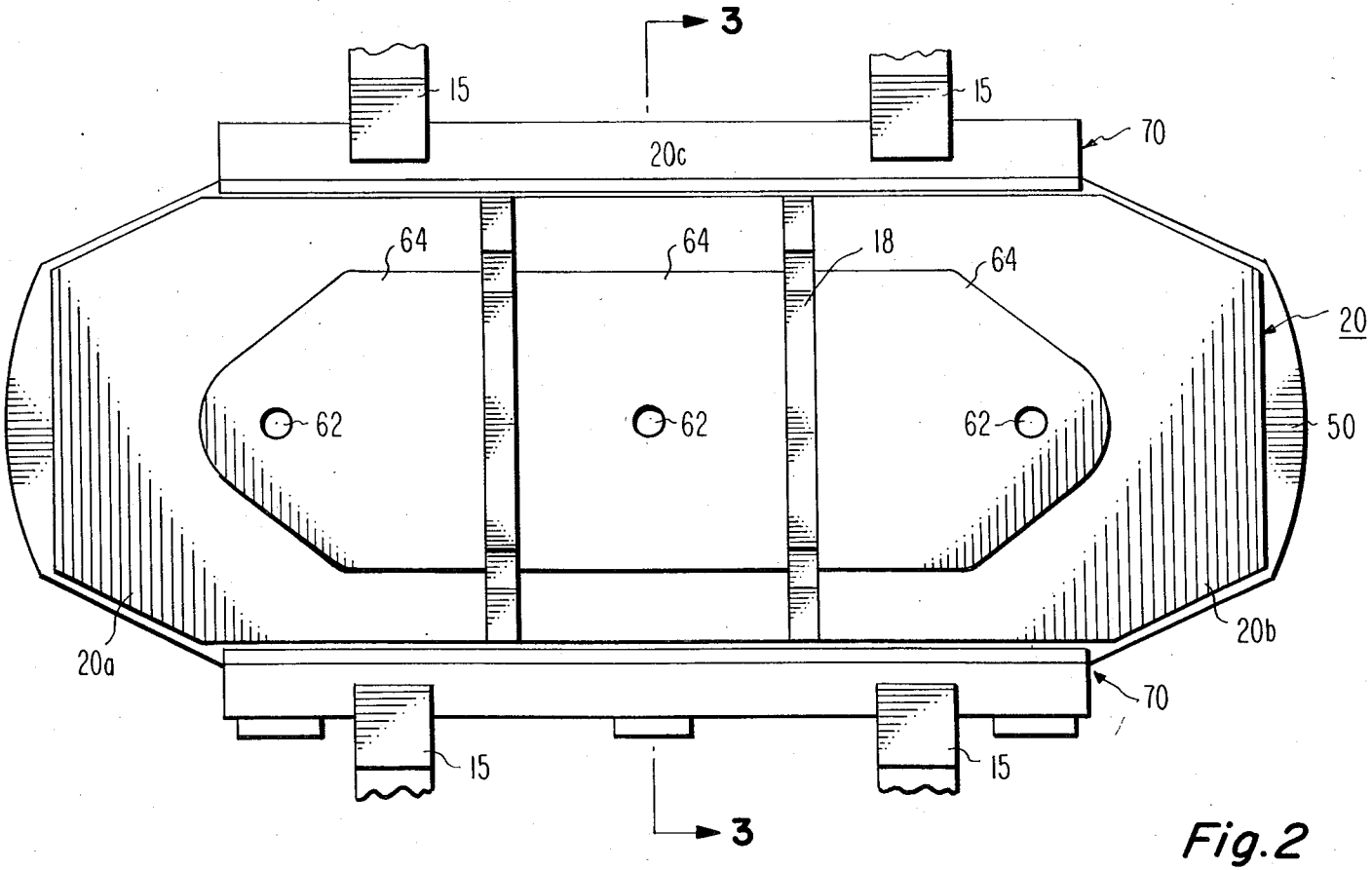
FIG. 2 is an enlarged plan view of a portion of the electron gun taken along line 2—2 of FIG. 1.
Figure 3:
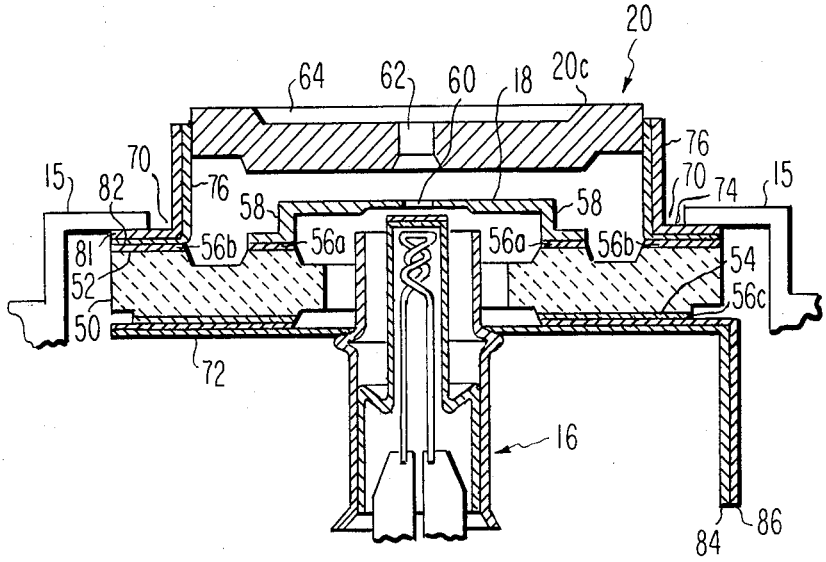
FIG. 3 is a sectional view taken along line 3—3 of FIG. 2.

The modular BFR assembly 12, shown in FIGS. 2 and 3, includes a ceramic member 50, having an alumina content of about 99%, to which the cathode assemblies 16 and the control grid and screen grid electrodes 18 and 20 are attached. The ceramic member 50 includes a first major surface 52 and an oppositely disposed substantially parallel second major surface 54. The ceramic member has a thickness of about 1.5 mm (0.06 inch). At least a portion of the first major surface 52 has metallizing patterns **56*a* and 56*b* formed thereon to permit attachment thereto of the electrodes 18 and 20, respectively. The metallized patterns 56*a* and 56*b* comprise discrete areas that are electrically isolated from each other. A plurality of electrically isolated metallizing patterns (only one of which, 56*c*, is shown) are provided on the second major surface 54 to permit attachment of the cathode assemblies 16 thereto. The metallizing of a ceramic member is well known in the art and needs no further explanation. The major surfaces 52 and 54 may include lands, as shown in FIG. 3, which facilitate application of the electrically isolated metallizing patterns thereto. The control grid electrode 18 is essentially a flat plate having two parallel flanges 58 on opposite sides of three inline, precisely spaced, beam-defining apertures 60, only one of which is shown. The screen grid electrode 20 preferably comprises three separate plate-like portions each of which has a beam-defining aperture 62 therethrough. The outer portions are designated 20*a* and 20*b* and the center portion is designated 20*c*. A recess 64 is formed in the surface of the screen grid electrode 20 that is adjacent to the lower first member 28 of the first focusing electrode 22, as shown in FIG. 1. The recess 64 provides a horizontal convergence correction of the outer electron beams to compensate for charges in focus voltage. This structure is described in U.S. Pat. No. 4,520,292 issued to van Hekken et al. on May 28, 1985 and is incorporated by reference herein for the purpose of disclosure. The separate portions 20*a*, 20*b* and 20*c* of the screen grid electrode 20 can be individually positioned so that the apertures 62 in the screen grid electrode 20 are aligned with the corresponding apertures 60 in the control grid electrode 18**.

In U.S. Pat. Nos. 4,298,818 and 4,500,808 the control and screen grid electrodes are brazed directly to the metallized patterns on the ceramic surfaces. The brazing of a plurality of formed metal parts tends to distort at least some of the parts and introduce stress into the ceramic member. If the stress is sufficiently great, the ceramic member will crack, rendering the cathode-grid assembly unusable.

U.S. patent application, Ser. No. 735,261 filed on May 17, 1985 by McCandless and assigned to the assignee of the present invention, discloses a substantially flat, bimetal transition member which is brazed to the metallized pattern on the ceramic member. The control and screen grid electrodes are then welded to the transition member. The thickness of the transition member is limited to about 20% of the thickness of the ceramic member so that minimal stress is introduced into the ceramic member during brazing. The McCandless patent application is incorporated by reference herein for the purpose of disclosure.

A drawback of the grid structure described in the McCandless patent application is that the longitudinal spacing between the control grid electrode and the screen grid electrode is provided by accurately controlling the heights of the respective flange portions of the electrodes as well as the flatness of the ceramic member. This requires two precision tool-formed metal grid electrodes and a precisely formed ceramic member. The high cost of such precision parts is an additional drawback that is overcome by the present novel BFR assembly 12.

Figure 4:
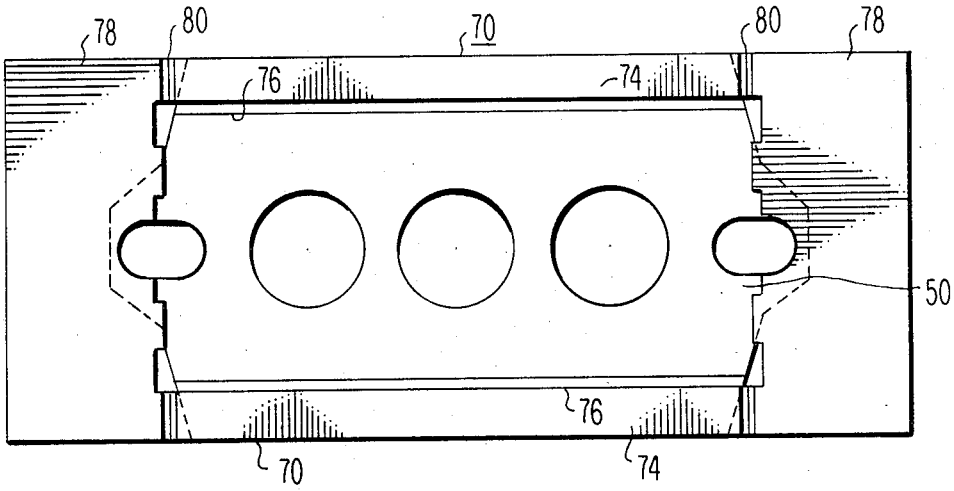
FIG. 4 is a plan view of a formed transition member according to the present invention.

As shown in FIG. 3, a formed transition member 70 is brazed to metallized pattern **56*b* simultaneously with the brazing of control grid 18 to metallizing pattern 56*a* on first major surface 52, and the brazing of a second transition member 72 to the metallizing pattern 56*c* on the second major surface 54. The formed transition member 70 has a substantially flat first portion 74 in contact with the metallized pattern 56*b* and upright portions 76 which are substantially perpendicular to the flat portion 74. As shown in FIG. 4, The transition member 70 includes a break-away frame 78 attached to the transition member 70 by V-notches 80. Transition member 72 also has a break-away frame (not shown) similar to that described in the above-referenced U.S. patent application, Ser. No. 735,261. The transition member 70 extends along both sides of the first major surface 52 so that the screen grid electrode 20 can be disposed between the substantially parallel upright portions 76. The height of the upright portions 76 is sufficient to permit longitudinal variations in the locations of the screen grid electrode portions 20*a*, 20*b* and 20*c* to accommodate variations in the height of the control grid 18, or irregularities in the flatness of the ceramic member 50. In other words, neither the ceramic member 50 nor the control grid electrode 18 is required to be a precision part since the portions 20*a*, 20*b* and 20*c* can be longitudinally located by means of appropriate shims (not shown) to provide the desired spacing between the successive electrodes. The lateral gap between the sides of the screen grid electrode portions 20*a*, 20*b* and 20*c* and the upright portions 76 of the transition member 70 can be as great at 50% of the thickness of the transition member 70 and still permit the forming of a reliable laser weld. In the present structure, the transition members 70 and 72 comprise face-to-face laminated bimetal layers. With respect to transition member 70, a first metal layer 81 is formed from a nickel-iron alloy of 42% nickel and 58% iron and has a thickness of about 0.2 mm (0.008 inches). A second metal layer 82 is preferably formed of copper and has a thickness of about 0.025 mm (0.001 inches). The melting point of the copper layer 82 is about 1033° C., and the melting point of the nickel-iron layer 81 is about 1427° C. The copper layer 82 is in contact with the metallized layer 56*b* on the first major surface 52. The transition member 72 also comprises a face-to-face laminated bimetal formed of a 0.2 mm thick nickel-iron layer 84 and a 0.025 mm thick copper layer 86 which is brazed directly to the metallized layer 56*c* on the second major surface 54. The BFR assembly 12 is attached to the electron gun 10 by welding the bead support members 15 to the flat first portion 74 of the transition member 70. Longitudinal spacing between the screen grid (G2) electrode 20 and the first focusing (G3) electrode 22 is established by using a removable shim (not shown) to set the desired spacing during the welding of the bead support members 15 to the flat portion 74. If necessary, the bead support members 15 may be bent to provide the proper spacing. Alternatively, the bead support members 15 may be embedded in the glass support rods 14** in such a position as to provide the desired G2 to G3 electrode spacing.

What is claimed is:

1. In a multibeam electron gun for a cathode-ray tube comprising a plurality of cathode assemblies and at least two spaced, successive electrodes having aligned apertures therethrough for passage of a plurality of electron beams, said cathode assemblies and said electrodes being individually held in position from a common ceramic member, said ceramic member having a first major surface and an oppositely disposed second major surface with a metallized pattern formed on at least a portion of each major surface, said electrodes being attached to said first major surface and said cathode assemblies being attached to said second major surface, wherein the improvement comprises a transition member disposed on said first major surface of said ceramic member, said transition member including a substantially flat portion attached to said metallized pattern and two upright portions substantially perpendicular to said flat portion, said upright portions being substantially parallel to each other, one of said electrodes being disposed between said upright portions and attached thereto, whereby said one electrode can be longitudinally spaced from the other electrode.

2. In an inline electron gun for a cathode-ray tube comprising three cathode assemblies and at least a control grid electrode and a screen grid electrode, each of said electrodes having three aligned apertures therethrough for passage of electron beams from said cathode assemblies, said cathode assemblies and said electrodes being individually held in position from a common ceramic member, said ceramic member having a first major surface and an oppositely disposed second major surface with a metallized pattern formed on at least a portion of each major surface, said electrodes being attached to said first major surface and said cathode assemblies being attached to said second major surface, wherein the improvement comprises said control grid electrode being attached to a first area of said metallized pattern on said first surface of said ceramic member, and a transition member being attached to a second area of said metallized pattern on said first surface, said second area being electrically isolated from said first area, said transition member having a substantially flat portion in contact with said second area and two upright portions substantially perpendicular to said flat portion, said upright portions being substantially parallel to each other, said screen grid electrode being disposed between said upright portions and attached thereto, whereby said screen grid electrode can be longitudinally spaced from said control grid electrode.

3. The electron gun defined in claim 2 wherein said transition member comprises two layers of metal bonded face-to-face to form a bimetal, one layer of metal having a melting point lower than the other metal layer, said layer of metal having the lower melting point being in contact with said second area of metallizing.

4. The electron gun defined in claim 2, wherein said screen grid electrode comprises three separate portions, each of said portions having an aperture therethrough which is aligned with a corresponding aperture in said control grid electrode, each of said portions of said screen grid electrode being individually spaced from said control grid electrode.

5. In an inline electron gun for a cathode-ray tube comprising a modular beam forming region assembly and at least one main lens assembly attached to at least two insulative support rods, said beam forming region assembly including three cathode assemblies, a control grid electrode and a screen grid electrode, each of said electrodes having three aligned apertures therethrough for passage of electron beams from said cathode assemblies, said cathode assemblies and said electrode being individually held in position from a common ceramic member, said ceramic member having a first major surface and an oppositely disposed second major surface with a metallized pattern formed on at least a portion of each major surface, said control grid electrode and said screen grid electrode being attached to said first major surface and said cathode assemblies being attached to said second major surface, wherein the improvement comprises said control grid electrode being attached to a first area of said metallized pattern on said first surface of said ceramic member, and a bimetal transition member being attached to a second area of said metallized pattern on said first surfaces, said second area being electrically isolated from said first area, said transition member having a substantially flat portion in contact with said second area and two upright portions substantially perpendicular to said flat portion, said upright portions being substantially parallel to each other, said screen grid electrode comprising three separate plate-like portions each of said portions being disposed between said upright portions of said transition member, each of said portions of said screen grid electrode having an aperture therethrough which is aligned with a corresponding aperture in said control grid electrode, each of said portions of said screen grid electrode being individually longitudinally spaced form said control grid electrode and attached to said upright portions of said transition member.

* * * * *